United States Patent [19]

Ghiardo et al.

[11] Patent Number: 4,638,840

[45] Date of Patent: Jan. 27, 1987

[54] WEFT FEEDER FOR WEAVING LOOMS

[75] Inventors: Fiorenzo Ghiardo, Vigliano Biellese; Bruno Maina, Valdengo, both of Italy

[73] Assignee: ROJ Electrotex S.p.A., Biella, Italy

[21] Appl. No.: 738,386

[22] Filed: May 28, 1985

[30] Foreign Application Priority Data

Jun. 4, 1984 [IT] Italy ..... 21249 A/84

[51] Int. Cl.[4] ..... D03D 47/36; B65H 51/20

[52] U.S. Cl. ..... 139/452; 242/47.01

[58] Field of Search ..... 139/452; 242/47.01, 242/47.12, 47.13

[56] References Cited

U.S. PATENT DOCUMENTS 4,452,402 6/1984 Ghiardo ..... 242/47.01

4,458,729 7/1984 Brouwer et al. ..... 139/452

4,498,639 2/1985 Deborde ..... 242/47.01

*Primary Examiner*—Werner H. Schroeder

*Assistant Examiner*—Joseph S. Machuga

*Attorney, Agent, or Firm*—Young & Thompson

[57] ABSTRACT

Weft feeder for weaving looms, of the type wherein the drum (1) around which the weft yarn winds to form the reserve is held stationary, while the turns (3) of the reserve are laid thereon by a rotating reel (2) and are moved forward, mutually spaced, by a set of columns (5) prevented from rotating in respect of said drum (1), but partially and variably emerging from special seats of its periphery. The ensemble of columns has a frustoconical profile, each column (5) being tapered towards the feeder outlet end, until it no longer emerges from the seats where there is maximum tapering. A photoelectric cell unit (8), moving parallel to the axis of the drum (1), detects the presence and the consistency of the weft yarn reserve wound thereon, in order to control the rotation and regulate the speed of the motor of the feeder.

3 Claims, 3 Drawing Figures

WEFT FEEDER FOR WEAVING LOOMS

BACKGROUND OF THE INVENTION

The present invention concerns a weft feeder for weaving looms.

It is known that weaving looms using as weft insertion means a carrier other than the shuttle, namely gripper looms, projectile looms and, lastly, air and water looms, require—for a proper working—the weft to be fed therein at a low and most regular tension.

It is also known that, in order to obtain this result, devices called weft feeders, or weft presenting devices, have already been adopted since some time in said looms, said devices being positioned between the bobbin—from which the weft is picked—and the loom insertion means, and forming a weft reserve wound on a drum in the form of successive turns, the unwinding of which takes place at a practically constant tension, the value of which is furthermore adjustable, thanks to a braking system at the outlet of the drum.

The object of the present invention is to provide important improvements in weft feeders of the type—since long developed and now generally preferred by loom constructors—wherein the drum around which the weft yarn winds to form the reserve is held stationary, while the turns of said reserve are laid thereon by a rotating reel and are moved forward, mutually spaced, by a set of columns prevented from rotating in respect of said drum, but partially and variably emerging from seats provided in its periphery.

As is known, it is very important in weft presenting devices not only to obtain a perfect arrangement of the yarn reserve turns, but also to be able to easily control the amount of yarn reserve present on the winding unit. While in weft presenting devices wherein the yarn reserve moves forward by adjacent turns, said control is advantageously performed by means of a photoelectric cell fixedly connected to the body of the apparatus, in the devices of the type heretofore described, wherein the turns are moved forward mutually spaced, it is necessary to make use of mechanical weft feelers. The photoelectric cell usually comprises a sending element and a receiving element, arranged so that the beam of light sent by the first element may be intercepted by the second through reflection from the actual yarn, or else onto a reflecting element applied on the winding drum. In the first case, the yarn presence modifies the electric signal outgoing from the photoelectric cell unit, due to the presence of a reflection on the yarn, while in the second case, the electric signal is modified through the presence of yarn preventing the reflection of the beam of light. In weft presenting devices where the yarn moves forward by adjacent turns, this is allowed—in the first case—by the fact that the adjacent turns form a reflecting surface with appropriate characteristics, and—in the second case—by the fact that the adjacent turns are adopted to provide a compact screen for the reflecting element.

In weft presenting devices where the yarn moves forward by mutually spaced turns—which are preferred because the advancement of the turns on the winding unit, controlled by the mobile columns, determines a uniform tension between the various turns laid, which makes the evenness of the reserve less strictly connected to the continuous rotation of the motor, than in weft presenting devices where the yarn moves forward by adjacent turns—it has up to date not been possible to read and control the amount of the reserve with the previously described photoelectric cell methods, due to the considerable spacing between the turns, which gives rise to uncertainties and even serious errors.

At present, in such devices, the yarn reserve is hence controlled by means of finger micro-switches, fixed to the outer body of the presenting device and whose fingers, bearing on the wound turns, indicate the presence thereof. The lack of turns on the winding unit, as they are fed to the loom, causes a lowering of the finger with a corresponding electric signal which, by rotating again the electric motor, allows the re-winding of new turns. However, the presence of the micro-switch finger, due to its physical contact with the wound turns, is prejudicial to the regular positioning thereof. In fact, especially if the yarn is very fine, the turns tend to fall out of order, determining tension variations at the outlet of the weft presenting device.

Even if attempting to overcome this drawback by adjusting the pressure of the finger on the turns (by acting on the spring which pre-loads the fingers, so as to apply only a slight pressure in case of very fine yarns), the inconvenience still remains in case of very thick yarns. In this event, in fact, the winding turn may stop in correspondence of the micro-switch finger, thereby indicating the presence of yarn reserve while this may be missing. It can therefore be easily understood how important it is to extend the use of photoelectric cell yarn detectors to weft feeders wherein the yarn moves forward by mutually spaced turns. This use would furthermore allow a more efficient control of the motor speed, which leads to the winding of new turns and to the picking of weft by the loom.

The technical improvements according to the present invention therefore concern a weft feeder, wherein an attempt has been made to combine the positive characteristics of the previous systems for moving forward the yarn reserve turns on the winding drum, so as to improve its performance, reducing at the same time the controls to a minimum in order to facilitate the use thereof.

Concerning the system adopted to move forward the turns of yarn reserve, the traditional system of mutually spaced turns has thus been adopted, modifying however the arrangement of said turns along the longitudinal axis of the winding unit. The turns are in fact moved forward by means of columns moving partially and variably emerging from the drum, while the configuration of the arrangement has been modified so as to obtain a progressive accumulation of said turns towards the outlet zone of the winding unit. This arrangement has allowed using a first reserve zone, with turns separated physically one from the other and having a uniform tension, and a second reserve zone, where the turns are first close and then in contact, so as to move forward by pushing, though being prevented from overlapping by the fact that the tension in said turns is now uniform.

This second zone of the reserve, where the turns lie in contact, allows reading and control with the help of photoelectric cell devices. In this zone, in fact, the adjacent turns form a surface whereon it is possible to obtain directly the reflection of the beam of light sent by the photoelectric cell, or preferably—to avoid the influence of the yarn colour, thereby providing a more efficient and reliable solution—said turns are adapted to form a compact screen for the reflecting element.

SUMMARY OF THE INVENTION

In order to realize these important and highly advantageous results, the present invention provides a weft feeder for weaving looms—of the type wherein the drum around which the weft yarn winds to form the reserve is held stationary, while the turns of said reserve are laid thereon by a rotating reel and are moved forward, mutually spaced, by a set of columns prevented from rotating in respect of said drum, but partially and variably emerging from special seats in its periphery—characterized in that the ensemble of said columns has a frustoconical profile, each column being tapered towards the feeder outlet end, until it no longer emerges from said seats where there is maximum tapering.

In said weft feeder, a photoelectric cell unit moving parallel to the axis of the drum, detects the presence and the consistency of the weft yarn reserve wound thereon, in order to control the rotation and regulate the speed of the motor of said feeder.

BRIEF DESCRIPTION OF THE DRAWINGS

The invention will now be described in further detail, with reference to the accompanying drawings, in which.

DESCRIPTION OF THE PREFERRED EMBODIMENT

Figure 1:
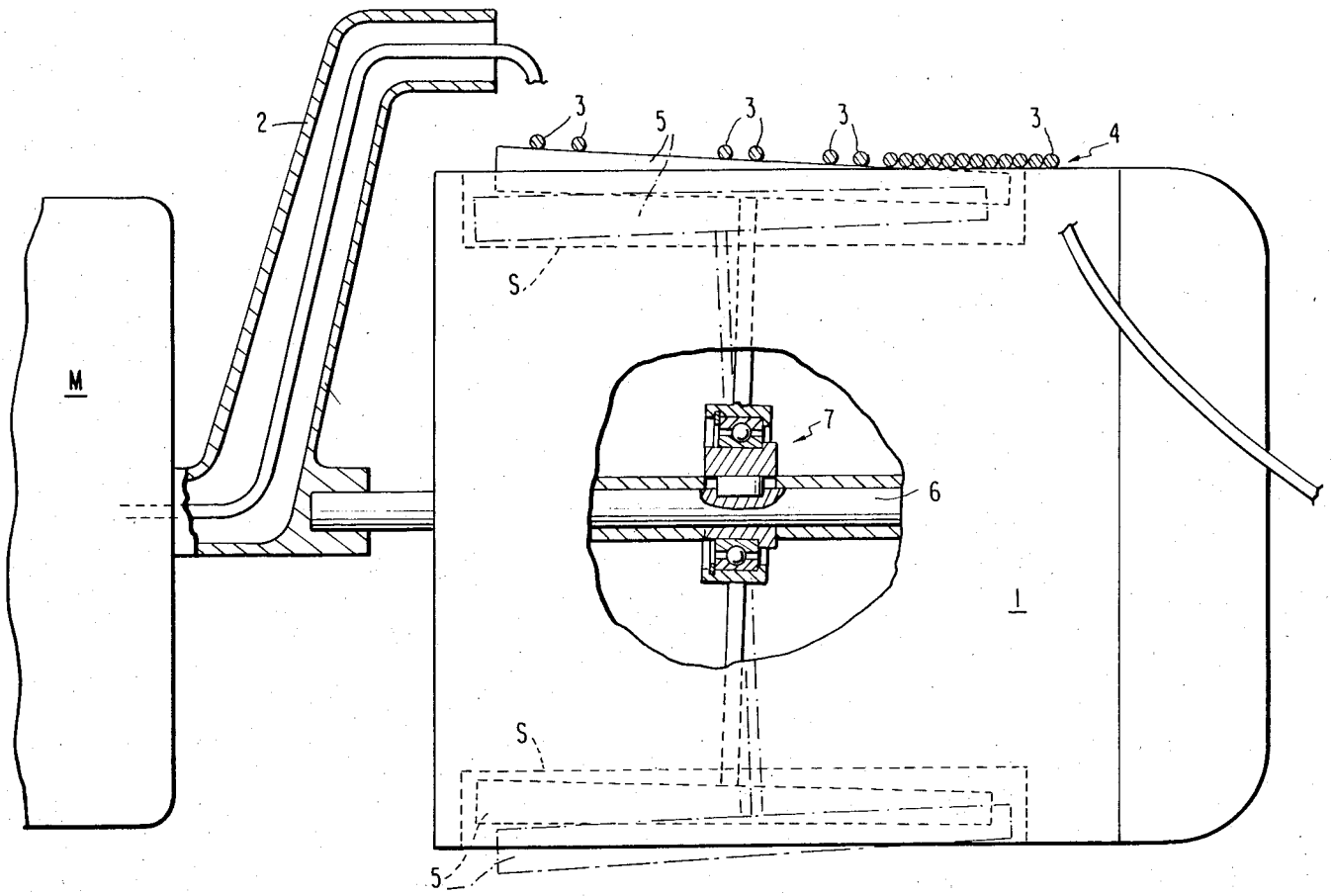
FIG. 1 shows diagrammatically the assembly of the drum on which are wound the weft yarn turns forming the reserve and of the columns moving forward said turns, of the weft feeder according to the present invention.

With reference to the drawings, in a weft feeder having a drum 1 which is held stationary, a rotating reel 2 driven by a feeder motor M winds weft turns 3 around said drum 1 to form a yarn reserve 4. The first turns 3, close to the reel 2, are moved forward—in known manner—by means of a plurality of columns 5, partially and variably emerging from the periphery of the drum 1, thanks to the motion imparted to said columns by the feeder motor shaft 6, in respect of which they are rotatably mounted by way of a support 7 comprising a skew bushing and a rotary bearing.

According to the invention, the ensemble of the columns 5—which up to date has always been made with a cylindrical configuration—takes up herein a frustoconical profile. Each column 5 is tapered towards the outlet end of the feeder, whereby its profile is inclined in respect of the cylindrical surface of the drum, into seats S in which—as known—the columns are housed, and are thereby prevented from rotating.

In this manner, while from the inlet or feeding end of the drum 1 the columns 5 emerge, partially and variably but anyhow considerably, from said drum—as in the conventional devices—, in the following zones towards the outlet end of the drum, said columns 5 emerge less and less, whereby their final part remains permanently inside the surface of the drum 1; they hence fully perform their function of lifting the turns—and moving them forward,—only along the initial part of the drum, thereafter progressively reducing their lifting action until, in the final part of the reserve, the turns can only move forward by being pushed by the previous turns, since the columns have stopped lifting them. This allows obtaining a turns distribution as shown in the drawings (and as was desirable), with separate and evenly spaced turns on the first part of the drum 1, and with an increasing accumulation of turns—which are thus adjacent and in strict pushing contact—on the final part of said drum.

This arrangement of the turns, besides having the advantage of giving a uniform tension to said turns, allows avoiding a considerable amount of yarn reserve such as would retard the acceleration of the electric motor during re-winding of a new reserve, thereby allowing the weft feeder to eminently perform its function of "storage unit" between the bobbin and the loom.

Figure 2:
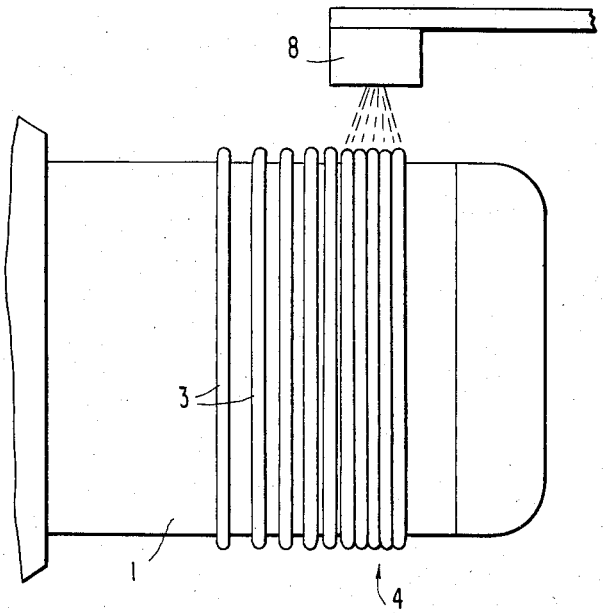
FIGS. 2 and 3 are two views at 90° one in respect of the other, showing how said assembly lends itself for detection of the reserve by a photoelectric cell.
Figure 3:
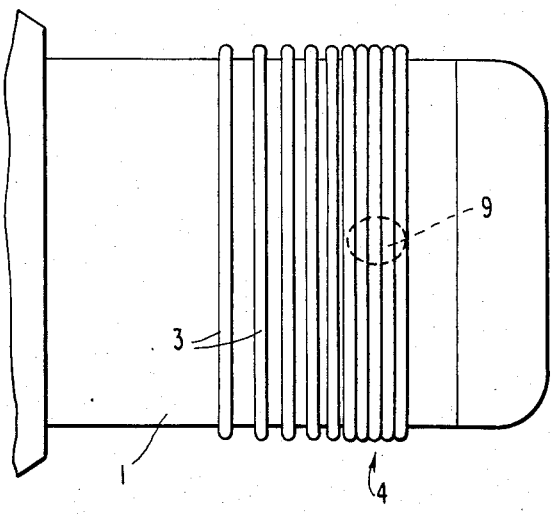

But above all, the arrangement according to the invention allows combining the two previous advantages with those of a photoelectric cell detection of the yarn reserve, which had never been possible up to date and which forms the main object of the invention. As shown in FIGS. 2 and 3, the light beam of a photoelectric cell 8 is reflected by a reflecting element 9, positioned on the drum 1, in the absence of yarn reserve. Whereas, in the presence of a reserve, the adjacent and contacting turns of its final stretch prevent the light beam from reaching the reflecting element 9 which they screen. The exposure or the screening of the reflecting element 9, and the consequent emergence or not of the light beam from the photoelectric cell 8, are adapted to give to the electric motor which controls the feeder the signals for operating or interrupting the winding of a new reserve.

If, however, the projection of the light beam from the photoelectric cell 8 is sufficiently large and the reflecting element is dimensioned accordingly, by processing with known methods the outgoing signal of the photoelectric cell 8 as a consequence of the progressive exposure and screening of the reflecting element 9, it is possible to regulate most effectively the acceleration and deceleration of the electric motor of the weft feeder and thus obtain the regular and prompt working thereof.

The invention also provides an improvement in the reading of the photoelectric cell unit, in that it allows easily varying its sensitivity when changing the type of yarn being wound.

It should in fact be noted that a weft feeder, in order to be of universal use, has to be able to work in optimum conditions both with a very fine weft and with a very thick weft.

With the previously described arrangement according to the invention, providing for a progressive accumulation of the weft turns of the yarn reserve, in the case of winding very thick or flat yarn, the turns are positioned adjacent already in the initial part of the drum where they are lifted and conveyed by the mobile columns; it is hence appropriate to enable the photoelectric cell to read the presence of a reserve already in this zone—so as to avoid an exceedingly large number of adjacent turns in the reserve—by shifting the position of the photoelectric cell unit towards the inlet of the weft yarn. The opposite of course occurs when winding finer yarns.

In practice, instead of having to provide for a continuous adjustment of the photoelectric cell unit parallel to the axis of the weft presenting device, only two fixed positions of adjustment have been provided for, one for normal and thick yarns and one for fine yarns, and provision is also made for the shifting of the photoelectric cell unit in the selected position to automatically vary also the sensitivity of the photoelectric cell (for instance, through a micro-switch system with mechanical or magnetic control).

The arrangement greatly simplifies the control of the weft feeder, in that it involves selecting only one of two possible positions of the photoelectric cell unit, according to the title and look of the yarn, while the motor speed is automatically regulated.

It is to be understood that the heretofore described and illustrated embodiment of the invention is merely an example and that further embodiments and modifications thereof can be realized, without thereby departing from the scope of the invention itself.

We claim:

1. A weft feeder for weaving looms, comprising a stationary drum, means to wind a weft yarn around the drum, a set of columns that extend along the drum from the feeder inlet end of the drum toward the outlet end of the drum and are disposed in seats in the periphery of the drum, a drive shaft disposed axially within the drum, a skew bushing on the drive shaft, and means mounting said columns on said skew bushing, the columns having outer surfaces inclined to the periphery of the drum such that upon rotation of the drive shaft, the skew bushing causes each column successively to take up a position in which the column has a portion adjacent said feeder inlet end which is substantially farther from the axis of the drum than is the periphery of the drum and a portion toward said feeder outlet end which extends radially outwardly of the drum no farther than the periphery of the drum, the drum having a portion of substantial axial extent adjacent said outlet end beyond which the columns do not extend, thereby to establish adjacent said outlet end a region on the drum in which the turns of weft yarn lie in contact with each other.

2. A weft feeder as claimed in claim 1, and a photoelectric cell directed toward the feeder outlet end of the drum for detecting the presence and completeness of the weft yarn reserve wound thereon, in order to control the rotation and to regulate the speed of the motor of the feeder.

3. A weft feeder as claimed in claim 2, and a light reflecting element mounted on the drum facing the photoelectric cell.

* * * * *